US005263621A

United States Patent [19]

Bedi

[11] Patent Number: 5,263,621

[45] Date of Patent: Nov. 23, 1993

[54] COUPON DISPENSING CARTRIDGE

[75] Inventor: Harvinder Bedi, Fresh Meadows, N.Y.

[73] Assignee: Thomson-Leeds Company, Inc.

[21] Appl. No.: 944,353

[22] Filed: Sep. 14, 1992

[51] Int. Cl.[5] ..... B26F 3/02

[52] U.S. Cl. ..... 225/13; 225/42; 225/52; 225/53; 225/90

[58] Field of Search ..... 225/12, 13, 42, 51, 225/52, 53, 54, 77, 82, 85, 90, 91

[56] References Cited

U.S. PATENT DOCUMENTS

| | | | |
|---|---|---|---|
| 978,052 | 12/1910 | Oehring | 225/13 |
| 4,047,652 | 9/1977 | Ehrlund | 225/77 |
| 4,199,090 | 4/1980 | Reed | 225/13 |
| 4,204,618 | 5/1980 | Reed et al. | 225/52 |
| 4,364,501 | 12/1982 | Curtiss, Jr. | 225/90 |
| 4,384,664 | 5/1983 | Roos | 225/52 |

FOREIGN PATENT DOCUMENTS

| | | | |
|---|---|---|---|
| 3605351 | 9/1987 | Fed. Rep. of Germany | 225/53 |

*Primary Examiner*—Hien H. Phan
*Attorney, Agent, or Firm*—Howard C. Miskin

[57] ABSTRACT

A disposable coupon dispensing cartridge includes a housing and a passageway section having top and bottom walls extending from the housing to a discharge opening. A roll of a band of coupons is contained in the housing and has a leading tail extending from the housing to the discharge opening. The coupon band is provided with longitudinally spaced indices and a metering mechanism is carried by a passageway wall and is responsive to the band indicia to releasably restrict further advance of the band upon withdrawal of a coupon through the discharge opening. The metering mechanism may include a band bellying projection on the bottom wall and a stop forwardly of the projection and the indicia are longitudinal slits or may include a longitudinally vertically movable return biased pin for releasably engaging indicia defining holes in the band and a cam for raising and lowering the pin with its longitudinal movement.

6 Claims, 4 Drawing Sheets

COUPON DISPENSING CARTRIDGE

BACKGROUND OF THE INVENTION

The present invention relates generally to improvements in coupon dispensing devices and it relates particularly to an improved disposable coupon dispensing cartridge which may be positioned at a merchandise point of sale.

It is a common practice to dispense coupons which carry information as to recipes, rebates, instructions which relate to respective merchandise being sold and pads containing such coupons are generally at location remote from the related merchandise, for example, at a central bulletin board. This practice is highly inconvenient and ineffective and is often time consuming and wasteful, since coupons are often taken in excess of that required or desired.

SUMMARY OF THE INVENTION

It is a principal object of the present invention to provide an improved coupon dispensing device.

Another object of the present invention is to provide an improved disposable coupon dispensing cartridge which may be easily and conveniently separably mounted at a point of sale of related merchandise.

Still another object of the present invention is to provide an improved disposable coupon dispensing cartridge in which successive cartridges are automatically metered to a coupon discharge station with the withdrawal of a leading accessible coupon.

A further object of the present invention is to provide an improved disposable coupon dispensing device of the above nature characterized by its reliability, ruggedness, low cost, ease and convenience of application and replacement and its great versatility and adaptability.

The above and other objects of the present invention will become apparent from a reading of the following description taken in conjunction with the accompanying drawings which illustrate preferred embodiments thereof.

A coupon dispensing cartridge in accordance with the present invention comprises a body member including a housing section and a passageway communicating with and extending from the housing and terminating in a discharge opening, a roll of a band of successive coupons contained in the housing and having a tail portion extending from the housing along the passageway to the discharge opening, the band having formed therein longitudinally spaced indices, and indexing means responsive to said indices for restricting the advance of the band along the passageway when a coupon advances along the passageway to a predetermined position.

In accordance with one embodiment of the invention, the indices are defined by longitudinally spaced transverse slits delineating successive coupons and the metering means includes a cam projection extending medially upwardly from the bottom of the passageway rearwardly of the discharge opening and a spot located proximate the leading edge of the passageway top wall. As the band is withdrawn along the passageway, it is bellied upwardly by the cam projection and the leading raised edge of the coupon delineating slot strikes to stop to restrict further advance of the coupon band. To withdraw the next coupon, it is released from the stop by depressing the front border of the leading coupon.

The cartridge may be provided with an alternative coupon metering mechanism in which the slits delineating successive coupons are replaced by longitudinally spaced indexing holes. The metering mechanism includes a medially located longitudinally and vertically movable sensing pin mounted on the passageway bottom wall and being biased to a retracted position. A stop limits the forward motion of the pin which, upon rearward movement from the stop, is depressed to disengage an indexing hole and by a cam and follower and, upon further retraction, is released for upward movement toward the successive coupon underface and for engagement with a following indexing hole with advance of the coupon band.

The improved cartridge is simple, rugged, highly reliable and precise, inexpensive, easy and convenient to apply and use and of great versatility and adaptability.

DESCRIPTION OF THE PREFERRED EMBODIMENTS

Figure 1:
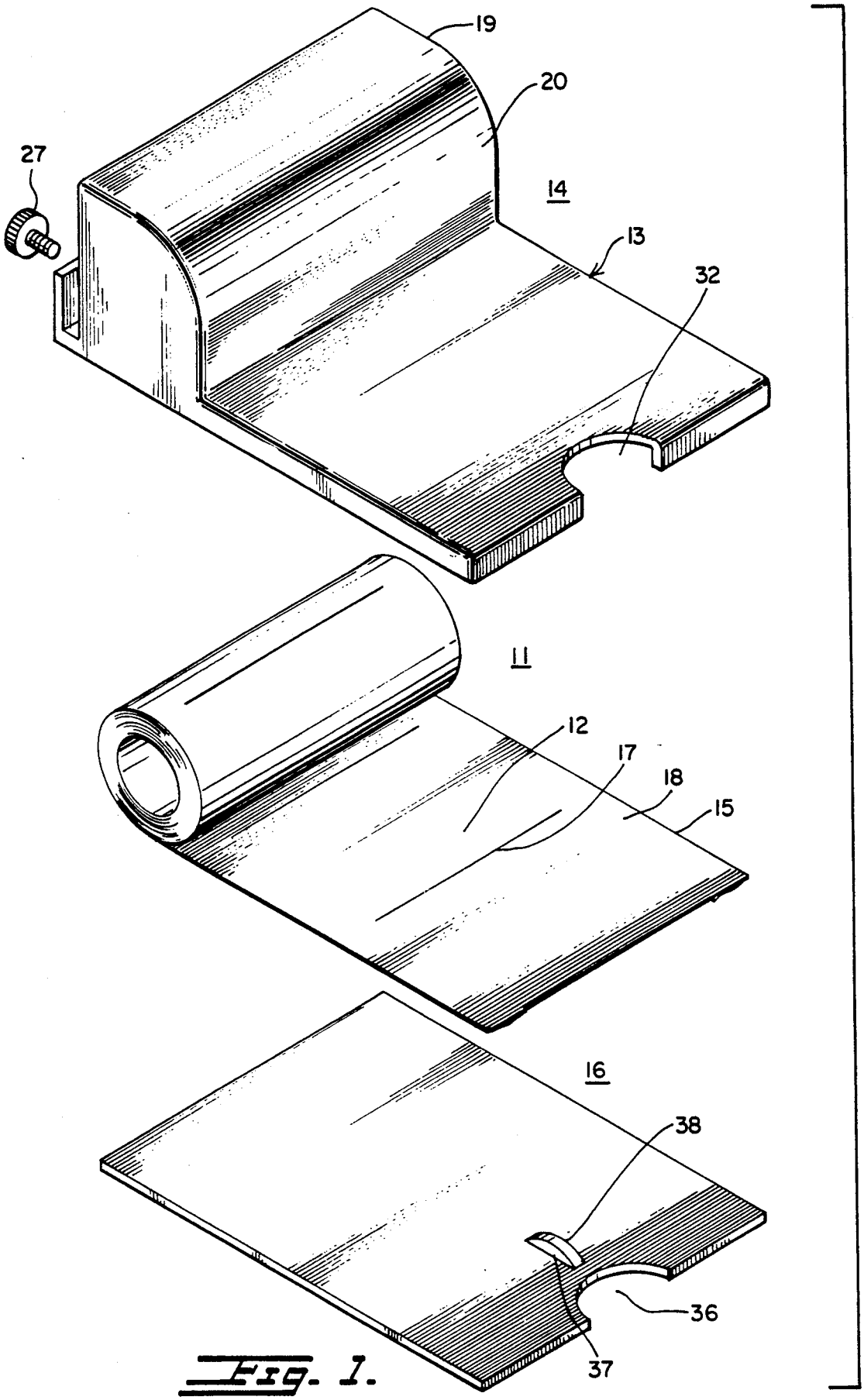
FIG. 1 is an exploded perspective view of a coupon dispensing device embodying the present invention.
Figure 2:
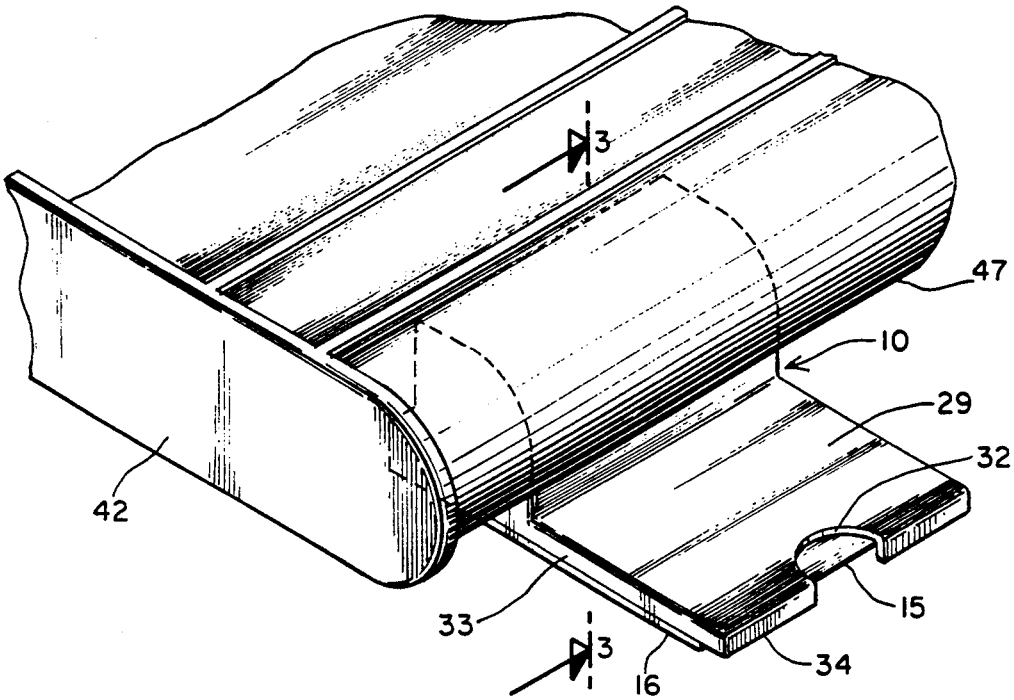
FIG. 2 is a perspective view of the assembled device shown in a shelf mounted position.
Figure 3:
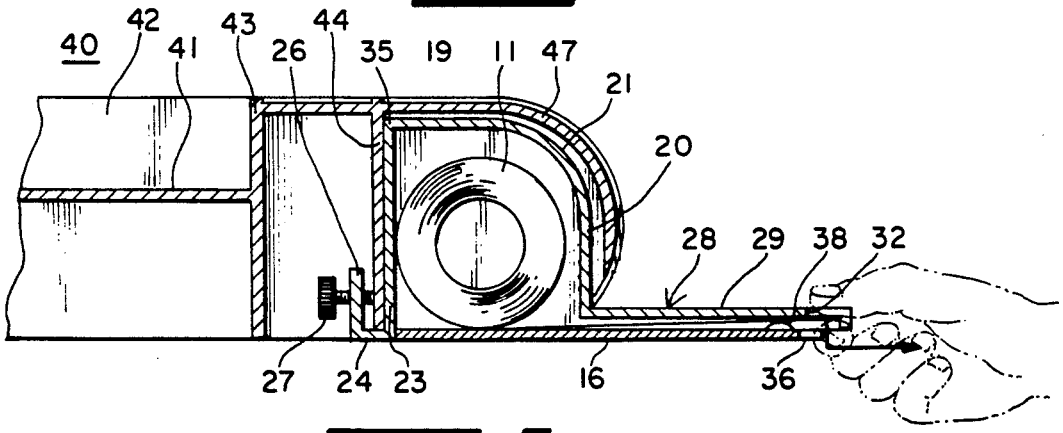
FIG. 3 is a sectional view taken along line 3—3 in FIG. 2.
Figure 4:
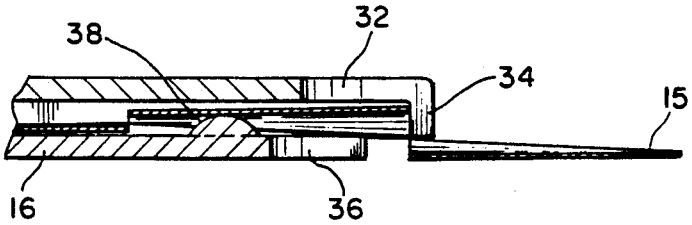
FIG. 4 is a fragmented enlarged view of a portion of the view of FIG. 3.

Referring now to the drawings, particularly FIGS. 1 to 4 thereof, which illustrate a preferred embodiment of the present invention, the reference numeral 10 generally designates the improved device or coupon cartridge which includes a roll 11 of a band 15 of a roll 11 of successive end-to-end coupons, tickets or the like 12 of a flexible material such as paper or thin cardboard and a container guide member 13 including a top section 14 and a bottom wall 16. The coupons 12 are separated by longitudinally spaced transverse slits 17 which extend laterally to points short of the side edges of band 15 to leave the side borders 18 uninterrupted by the slits.

Top section 14 and bottom wall 16 are advantageously formed of a synthetic thermoplastic resin, upper section 14 including a rear housing 35 for containing a coupon roll 11 and being defined by a top wall 19 joined to a depending front wall 20 by a transverse cylindrical upper front wall 21 and closed at its sides by end walls 22 and at its rear by a vertical wall 23. The bottom edge of rear wall 23 is below the bottom edge of front wall 20 and is joined by a rearwardly projecting horizontal flange to a rearwardly located vertical flange 26 having a threaded medial opening engaged by a thumb screw 27.

A tubular guide member 28 includes a horizontal rectangular top wall 29 extending forwardly from and integrally formed with the bottom of front wall 20 and having medially formed in its front border an arcuate finger notch 32. Depending from the side edges of wall 29 are depending flanges 33 and depending from the front edge of wall 29 on opposite sides of notch 32 are coplanar stop defining flanges 34 which extend to flanges 33.

Bottom wall 16 is rectangular and is suitably affixed to the bottom edges of flanges 33 and extends from vertical wall 23 to a point rearwardly of flange 34. An arcuate notch 36 is medially formed in the front border of wall 16. Formed on the top face of wall 16 shortly rearwardly of notch 36 and in longitudinal alignment therewith is a medially located rise defining arcuate vertical projection 38 having a cylindrical convex top cam face 38.

The coupon roll 11 is freely rotatably contained in housing 35 and in the dispensing ready condition of device 10 the coupon band 12 forming roll 11 extends tangentially from the bottom of roll 11 along guide member 13, over projection 38 to flange 34. As the band 12 passes over the trailing upwardly forwardly inclined cam face of projection 38, it is bellied upwardly about its medial longitudinal axis and the bellied front edge of band 12 abuts the rear face of flanges 34 preventing the advance movement of band 12.

A suitably mounted shelf member 40 includes a merchandise supporting platform 41 provided with end walls 42 extending along and forwardly of and above and below platform 41. Integrally formed with and extending along the front edge of platform 41 is an inverted open bottom U-shaped channel 43 having longitudinally extending vertical front wall 44. A shield member 46 projects from and is integrally formed with and projects forwardly of the top border of wall 44 and includes an open bottom longitudinally extending shield wall 47 complementing the cartridge walls 19 and 20. In the operating condition of cartridge 10, the housing 35 nests in shield 47 with the bottom border of channel wall 44 loosely embraced between flange 26 and channel wall 44 and releasably locked in position by the tightening of thumb screw 27.

In the operation of the cartridge 10, a coupon is withdrawn by grasping the leading coupon 18 with the thumb and forefinger through notches 32 and 36, pressing the coupon front border below flanges 34 and pulling the coupon forward. With the advance of the coupon band 15 by pulling the leading coupon 12, it passes over the forwardly upwardly inclined trailing cam face of projection 38 the band 15 is upwardly bellied about its medial longitudinal axis. Upon the slit 17 following leading coupon 12, the leading edge of the next successive coupon 12 is raised above the trailing edge of the withdrawn leading coupon as delineated by the separating slit and abuts flanges 34 to restrain further advance of the coupon band 15. The leading coupon is detached from the band by severing the side borders along the bottom edges of flanges 34. The cartridge is ready for withdrawal of the next coupon as described above. Upon depletion of the coupons, the cartridge may be removed and discarded and replaced by a coupon full cartridge.

Figure 5:
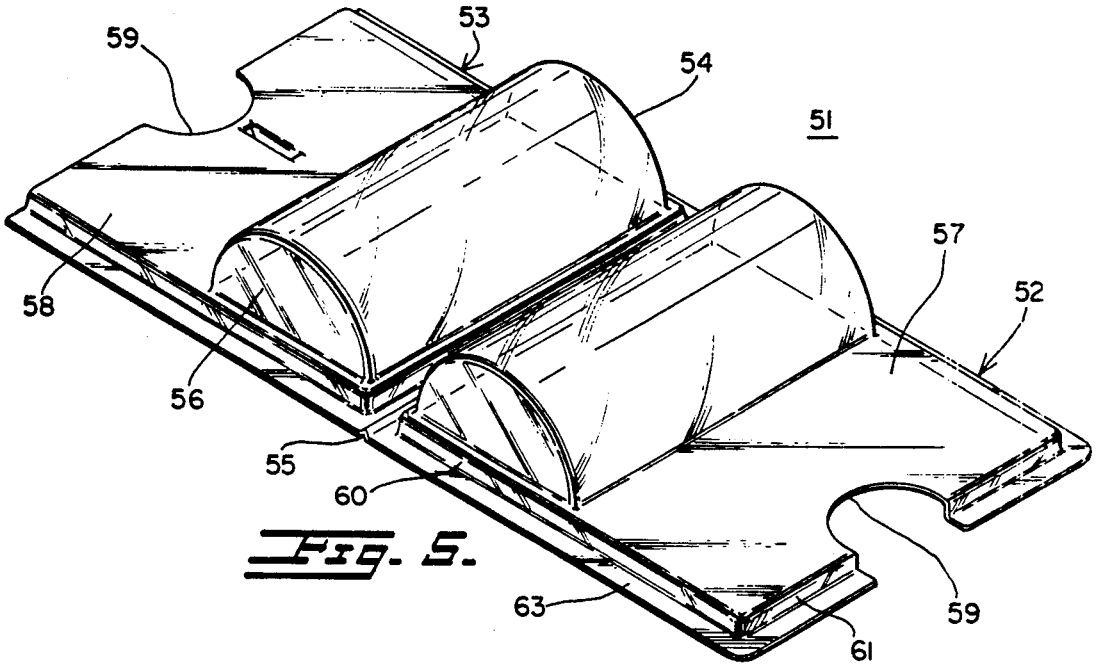
FIG. 5 is a perspective view of a molded member employed in forming the container portion of another embodiment of the invention.
Figure 6:
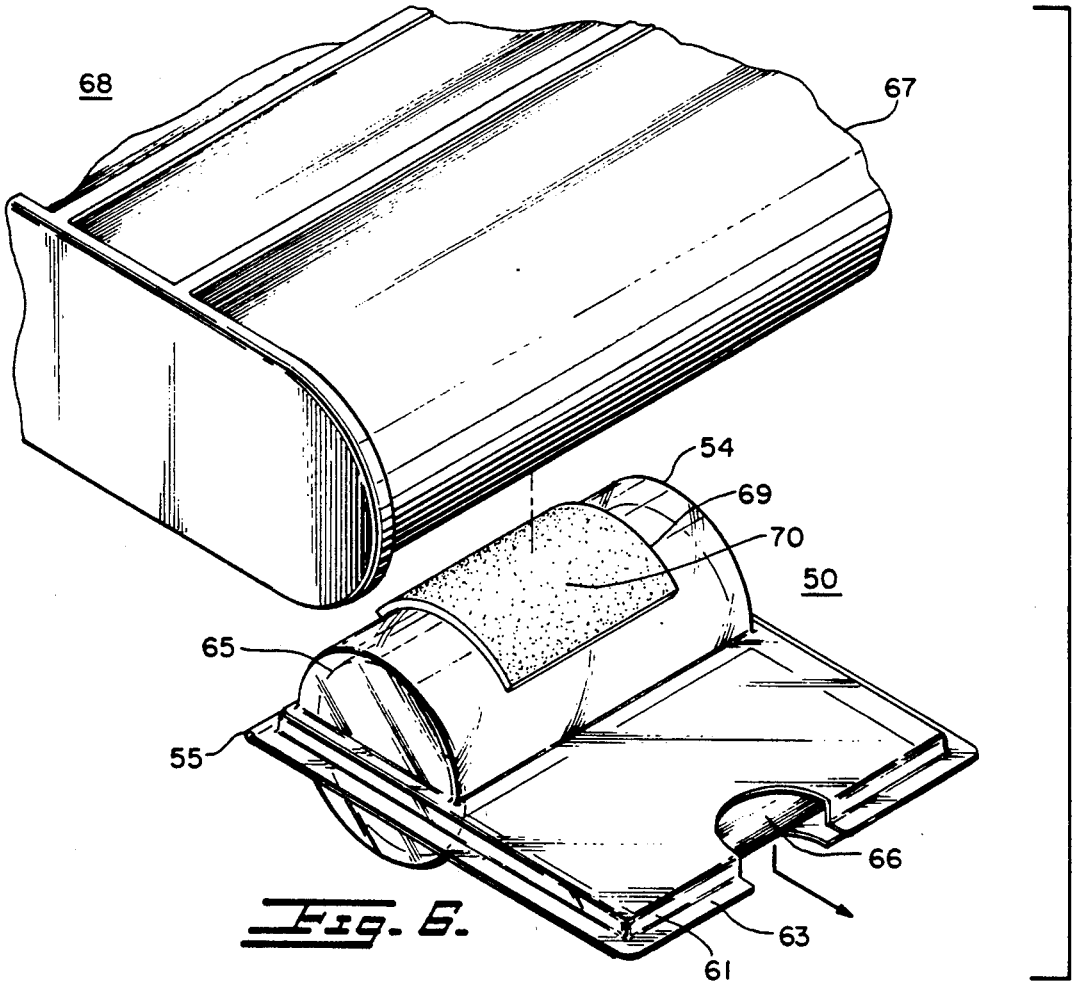
FIG. 6 is a perspective view of the assembled device of the embodiment of FIG. 5 attendant to its mounting to a shelf.
Figure 7:
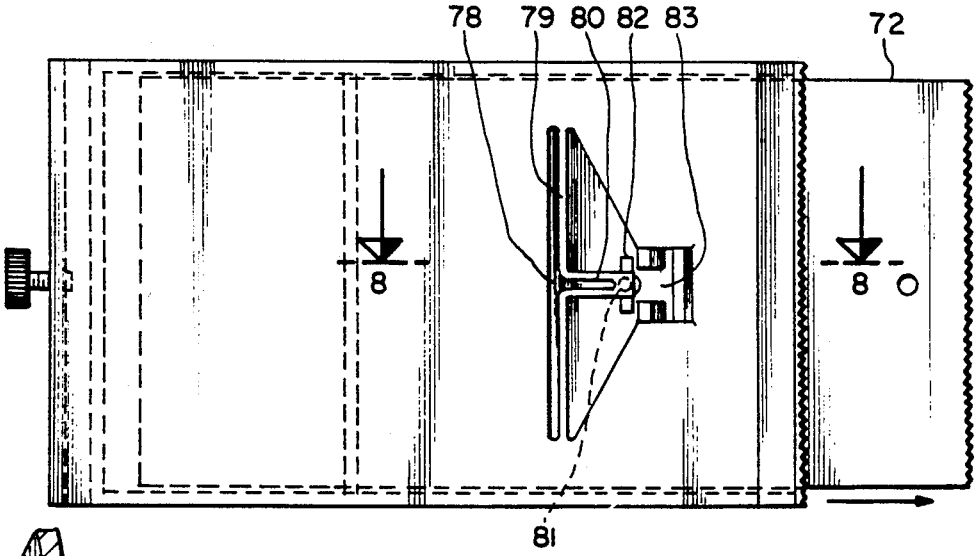
FIG. 7 is a bottom plan view of a further embodiment of the present invention.

The embodiment of the present invention illustrated in FIGS. 5 and 6 differs from that first described primarily in that it may be easily produced by vacuum forming or the like and is of lower cost. Specifically, the improved modified cartridge is formed of a single molded thermoplastic blank 51 which includes a pair of top and bottom complementary sections 52 and 53 joined by a transverse medial self hinge 55.

Each section 52,53 includes a transversely extending semicircular open bottom tubular shell portion 54, closed by end walls 56, coplanar flat guide walls 57 and 58 extending outwardly from the outer bottom edges of shell portions 54. Semi-circular notches 59 are medially formed in the outer end borders of walls 57, 58, and a narrow skirt wall 60 depends from the side edges of walls 57 and 58 and skirt walls 61 depend from the end edge wall 57 on opposite sides of notch 59, skirt walls 60 and 61 terminating in coplanar outwardly projecting flanges 63. A medially located semicircular projection 64 depends from wall 58 shortly inwardly of slot 59 formed therein.

In the assembled condition of cartridge 50, sections 52 and 53 are folded about hinge 55 with a coupon roll 65 similar to roll 11 earlier described contained between shell portions 54 and the confronting faces of flanges 63 are suitably mutually affixed in any suitable manner such as by heat welding, cementing or the like. The leading coupon 66 of roll 65 extends between the passage delineating walls 57, 58 to the skirt walls 61 and is accessible through notches 59.

The cartridge 50 is separably mounted in the open bottom channel 67 of a shelf member similar 68 similar in construction to shelf member 40 and is releasably secured therein by a tape suitably affixed to the top face of upper shell portion 54 and possess a pressure sensitive adhesive outer face. Pressure sensitive tape face 70 releasably adheres to the confronting face of channel 67.

The operation of the cartridge 50 is similar to that of cartridge 10 as earlier explained.

In FIGS. 7 to 11 of the drawings, there is illustrated an alternative coupon metering mechanism which may be substituted for that in the first described embodiment and is employed with a roll of coupons in which a medially disposed index hole replaces each of the slits 17 delineating successive coupons.

A tubular passageway 70 extends from a housing 71 which contains a roll of coupons 72, a medially located index hole being formed in the coupon band between successive coupons. Passageway 70 includes rectangular vertically spaced parallel top and bottom walls 73 and 74 respectively and terminates in a discharge opening. A forwardly downwardly inclined lip 76 extends from the leading end of bottom wall 74 and has a front cutting edge 75, and wall 73 has medially formed in its forward border a curved notch 77.

A triangular window 78 symmetrical to the medial longitudinal axis of passageway 70 is located in bottom wall 74 with its apex being forwardly directed. Transversely aligned resilient arms 79 extend toward each other from opposite sides of and are integrally formed with window 78 proximate its rear base and are joined at their inner ends by a forwardly projecting U-shaped resilient arm 80 having formed at its forward end an upwardly projecting indexing pin 81. Projecting laterally from opposite sides of pin 81 are cylindrical cam followers 82. The pin 81 is vertically and longitudinally movable and biased by arms 79 and 80 to a depressed retracted position. A rectangular opening 83 is medially formed at the ape of window 78 and has formed at the sides thereof a pair of laterally spaced depending cam member 84 and across the leading transverse edge thereof a depending stop member 86.

Each cam member 84 has a trailing rear upwardly forwardly inclined first cam face 87, a leading upwardly forwardly inclined second cam face 88, a horizontal bottom face 89 and a trailing vertical face 90. Depending stop member 86 has a transversely extending notch 91 formed along its upper trailing edge. A medial slot 92 is formed in top wall 73 and is slidably engageable by pin 81.

Figure 8:
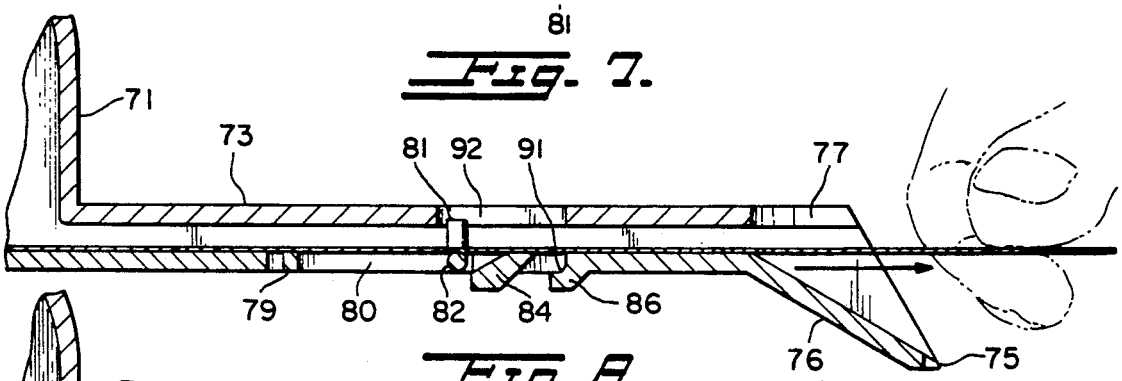
FIG. 8 is an enlarged sectional view taken along line 8—8 in FIG. 7 showing the condition of the device at the initiation of the withdrawing of a coupon.
Figure 9:
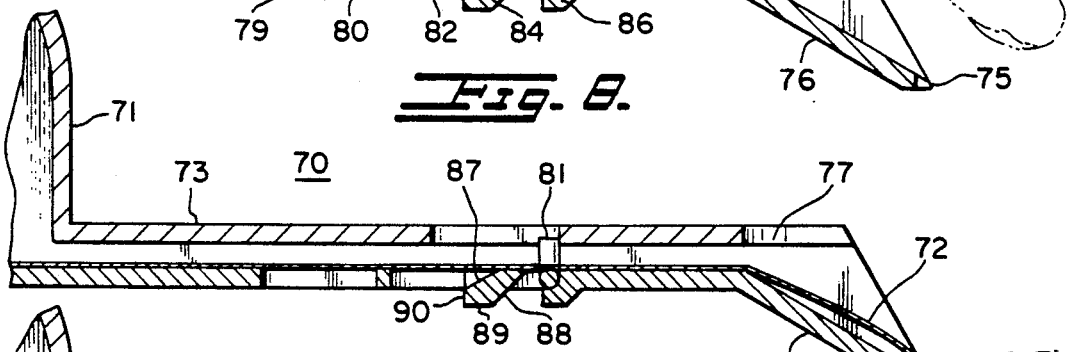
FIGS. 9 to 11 are views similar to FIG. 8 but showing successive steps in the withdrawal of a coupon.
Figure 10:
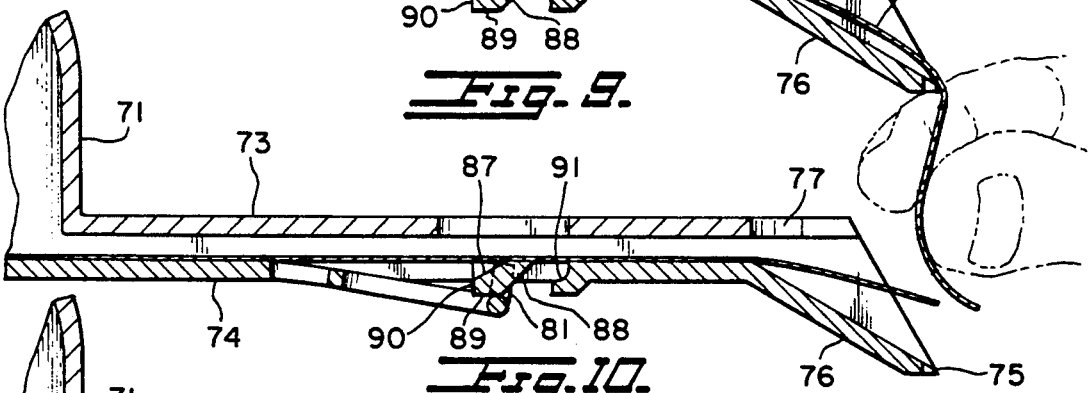
Figure 11:
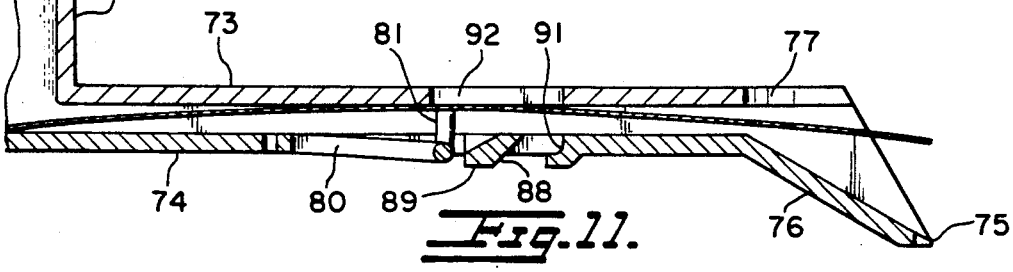

Considering the operation of the metering mechanisms last described, in its rest ready position indexing pin 81 engages an index hole in the overlying coupon band, and slot 92 proximate its trailing end and rearward of cam members 84 as seen in FIG. 8. An operator grasps the leading coupon 72 and pulls the coupon band forward, the pin 81 and followers 82 being forwardly advanced with the follower 82 being raised by cam faces 87 permitting them and pin 81 to advance where pin 81 is stopped by the leading face of slot 92 and the followers are urged into engagement with notch 91 to restrict further advance of the coupon band. During the last sequence, the arms are loaded. The operator then severs the leading coupon from the next successive coupon along the free serrated cutting edge of lip 76. The coupon band is thus released permitting a partial retraction of the coupon band and the downward rearward movement of followers 82 along cam faces 88 along cam faces 89 and 90, rearwardly past the cam members permitting the raising of pin 81 by arms 79 where it may engage a coupon band index hole either immediately or with a small advance of the coupon band thereby permitting a repetition of the above sequence.

While there have been described and illustrated preferred embodiments of the present invention, numerous alterations, omissions and additions may be made without departing from the spirit thereof.

I claim:

1. A coupon dispensing cartridge comprising a body member including a housing section and a passageway section having spaced top and bottom walls and communicating with and extending from said housing section and having a leading discharge opening, a roll of a band of successive coupons contained in said housing section, said band having formed therein longitudinally spaced indices delineating successive coupons and a leading portion extending along said passageway section to said discharge opening, and metering means located on said body member and responsive to said indices for releasably restricting further advance of said coupon band upon withdrawal of a leading coupon and including a stop located forwardly of said discharge opening in registry with said passageway and a band bellying projection located on said bottom wall a short distance rearwardly of said discharge opening toward and to a level short of said top wall.

2. The cartridge of claim 1 wherein said passageway section top and bottom walls are parallel.

3. The cartridge of claim 2 wherein said top wall has formed in the leading border thereof proximate said discharge opening a medially located access notch.

4. The cartridge of claim 1 wherein said top wall extends forwardly of said bottom wall and said stop depends from the leading edge of said top wall.

5. The cartridge of claim 1 wherein said projection is transversely medially located on said bottom wall and has a forwardly upwardly inclined rear face.

6. The cartridge of claim 1 including means for separably affixing said cartridge to a support.

* * * * *